United States Patent [19]

Kotitschke et al.

[11] Patent Number: 4,735,689

[45] Date of Patent: Apr. 5, 1988

[54] DEVICE FOR INTRODUCING AN ENDLESS BELT INTO A PAPER MAKING MACHINE

[75] Inventors: Gerhard Kotitschke, Steinheim; Karl Gröner, Heidenheim, both of Fed. Rep. of Germany

[73] Assignee: J. M. Voith GmbH, Fed. Rep. of Germany

[21] Appl. No.: 822,688

[22] Filed: Jan. 23, 1986

Related U.S. Application Data

[63] Continuation of Ser. No. 513,374, Jul. 13, 1983, abandoned.

[30] Foreign Application Priority Data

Aug. 25, 1982 [DE] Fed. Rep. of Germany ..... 3231511

[51] Int. Cl.[4] ..... D21F 3/04

[52] U.S. Cl. ..... 162/273; 162/358

[58] Field of Search ..... 162/200, 273, 358, 274

[56] References Cited

U.S. PATENT DOCUMENTS

| | | | |
|---|---|---|---|
| 2,938,581 | 5/1960 | Beachler | 162/200 |
| 4,267,018 | 5/1971 | Haltsonen et al. | 162/273 |
| 4,481,078 | 11/1984 | Nicni | 162/200 |

FOREIGN PATENT DOCUMENTS

WO82/02413 7/1982 World Int. Prop. O .

*Primary Examiner*—Steve Alvo

*Attorney, Agent, or Firm*—Ostrolenk, Faber, Gerb & Soffen

[57] ABSTRACT

Apparatus for introducing a felt belt into the press section of a paper making machine. The endless loop belt is supported on a pair of support bars or, in an alternate embodiment, on a single support bar, which are provided on a frame comprised of two side parts held together by the support bars. Both of the support bars are located outside the belt loop. The belt loop is pulled up and draped over one or both of the support bars defining one or more folded regions of the belt at one or both of the support bars, which shortens the suspended length of the belt. A clamping device, typically secured to the side parts of the frame, clamps the folded region of the belt to the support bar while the belt is introduced into the press section. After the belt has been introduced into the press section, the device including its frame is unclamped from the folded regions of the belt and removed from the machine.

13 Claims, 3 Drawing Sheets

DEVICE FOR INTRODUCING AN ENDLESS BELT INTO A PAPER MAKING MACHINE

This Application is a continuation of Ser. No. 513,374, filed July 13, 1983, and now abandoned.

BACKGROUND OF THE INVENTION

The present invention relates to a device for introducing an endless belt into a paper making machine, and particularly for pulling a felt belt into the press section of the paper making machine.

One device of this type is known from German DE-OS No. 31 00 522, which corresponds to PCT Publication No. WO 82/02413. In that case, a frame is provided for the introduction of an endless loop felt belt. The frame carries at least one support bar having a length which is approximately equal to and which extends across the width of the endless belt, from which the endless belt can be suspended. The felt belt which is wound on the support bars is partly unwound to form an open belt loop. Thereupon the support bars together with the felt belt are fastened to the frame. After the felt belt has been introduced into the paper making machine, the support bars contained within the loop of the felt belt must be pulled individually out of the paper machine from the side. Only then can the frame also be removed, for instance by being moved out laterally. In modern wide paper machines these operations require much time, so that the manufacture of paper is interrupted for a relatively long period.

SUMMARY OF THE INVENTION

The object of the present invention is to enable introduction of a new endless belt into a paper machine faster than was previously possible.

It is another object of the invention to improve the suspension of an endless loop belt from support bars as the belt is installed in the paper making machine.

According to the invention, the support bars which serve for suspending the endless belt are located entirely outside the belt loop. Generally two support bars are provided. The device in accordance with the invention can, however, also be developed so that only a single support bar is arranged outside the belt loop.

If the endless belt has been wound during its transportation or storage on bars which are arranged within the belt loop, they are removed before the device according to the invention is used. As a rule, however, the edless belt is wound from the very start (during transportation and/or storage) only on a single winding bar which is locate outside the belt loop.

At the support bar which is located outside the belt loop, the belt is pulled around the support bar which defines a double thick folded region of the belt which is draped over the support bar. If desired, the suspended belt loop may be pulled again either over the same support bar or over the other of two support bars defining a second similar folded region which in the first case is overlaid over the first folded region and in the second case is draped over the other support bar. The double folded regions reduce the length of the belt loop which is then installed in the paper making machine. It is desirable to keep the open loop smaller during the introduction than when the paper making machine is ready for operation. Therefore, two folded regions are preferably formed, and in special cases, there may even be three such regions. Upon removal of the support bars, the folded regions of the belt simply disappear and the belt is restored to its original full length.

Another feature of the invention is a clamping device which holds a folded region, and preferably two folded regions if they have been formed, of the endless belt fast while the endless belt hangs in the form of an open belt loop from the support bar or the two support bars.

Forming one or two folded regions in the endless belt usually does not represent any danger for the belt, particularly for a felt belt or a plastic wire belt. However, for metal wire belts, the device of the invention usually cannot be used.

The invention has the advantage that after the suspended endless belt is introduced into the paper machine, it can be removed from the device of the invention within a few seconds by loosening the clamping device, and then the device can immediately be moved out of the paper machine. The traveling crane which is always present above the paper making machine is preferably used to lift the device together with the endless belt, to introduce the belt and the device into the paper machine and thereafter to immediately move the device out of the paper machine. The crane is required for only a very short period of time during this process, since the support bars remain in the device during belt introduction.

The construction according to a preferred embodiment of the invention makes it possible to form a rather wide belt loop. This facilitates the introduction of the belt over a plurality of belt rolls including a roll which cooperates with the press roll and over belt supporting guide rolls.

Preferably, at least one of the support bars serves as a part of the belt clamping device, i.e. the folded region of the endless belt is held fast directly on one support bar. Where there is a single support bar, the folded region would be draped thereover and preferably clamped thereto. Where two support bars are provided, a folded region is draped over at least one of them and clamped thereto. If two folded regions are pulled in the belt, it is possible to drape both of them over one of the two support bars, and clamp them in place, or to drape one of the folded regions over one of the support bars and the other folded region over the other support bar, and to clamp them in place with the respective clamping device.

The frame to which the support bars are supported is itself comprised of two side parts which extend between the support bars and are spaced apart. This is a simple structure. The side parts have spaced apart recesses in which respective support bars are disposed. Clamping devices at the side parts of the frame clamp the support bars in the recesses of the side parts. As a result, after introduction of the belt, the frame can be broken down by a few manipulations into its main components, two side parts and two support bars, and can be stored in a space-saving fashion.

This embodiment can be developed particularly simply where the same clamping device that clamps the support bars to the side parts of the frame also serves to hold the folded regions of the loop belt to the support bars. Therefore, within the region of at least one of the support bars, the clamping device is used both to fix this support bar to the side parts and to hold the belt on this support bar.

Preferred embodiments of the invention are described below with reference to the accompanying drawings.

DESCRIPTION OF THE PREFERRED EMBODIMENTS

Figure 1:
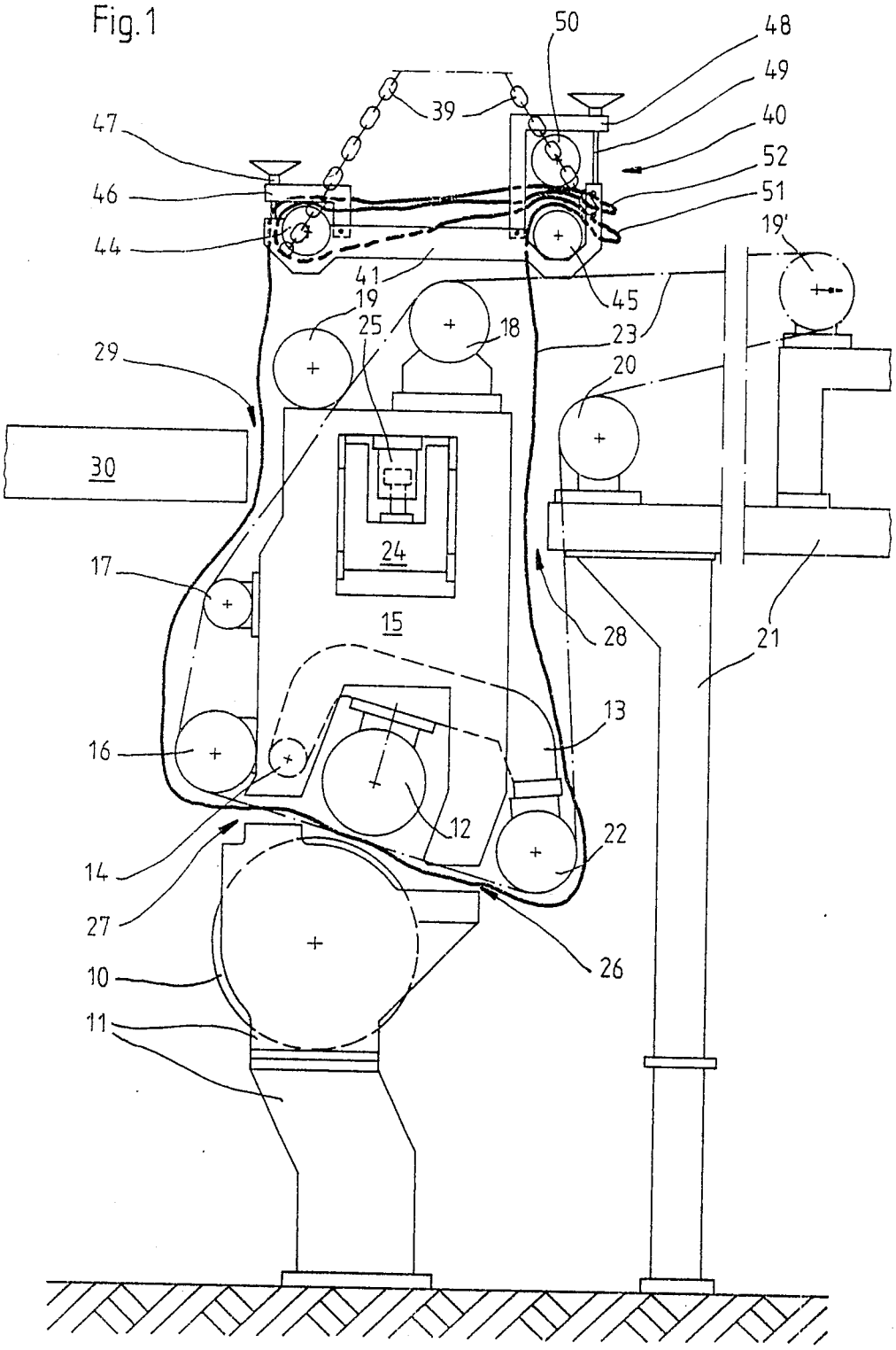
FIG. 1 shows a roll press of a paper machine, as seen from the operator's side, during the introduction of a new endless felt belt.

The roll press shown in FIG. 1 is part of a paper making machine. It comprises a larger diameter, lower press roll 10 mounted in a stationary stand 11 and an upper press roll 12 which is mounted on a swing lever 13. The swivel bearing 14 of the lever 13 is arranged in a supported bearing support block 15. This support block 15 also carries the mounts for the felt belt guide rolls 16, 17 and 18. In the condition shown in FIG. 1, a tension roll 19 is also supported on the support block 15. The roll 19 is normally moved to and mounted in the position 19′ on a separate stationary stand 21 after the belt 23 has been placed in the machine. Another guide roll 20 is also supported on the stand 21. Finally, a further guide roll 22 is also mounted on the free end of the swing lever 13. All of the guide rolls guide a flexible, tensioned, endless felt belt 23, which normally extends approximately along the dot-dash line. The felt belt 23 is shown in the heavy solid line to illustrate its condition when it has just been introduced from the operator's side into the paper machine.

During introduction of the felt belt, the bearing support block 15 is supported on the operator's side temporarily only on a cantilevered support 24, via a hydraulic cylinder 25 which is acted on by a pressure fluid. This is known from German DE-OS No. 29 43 974, which generally corresponds to U.S. application Ser. No. 435,484, filed Oct. 20, 1982. In its normal operating condition, on the other hand, the support block 15 rests via intermediate members on the stand 11. The intermediate members have been removed in the condition shown in FIG. 1. But, they normally fill the spaces at 26 and 27. The spaces 28 and 29 which are present between the support block 15 and the stand 21 and the longitudinal support 30 are also normally filled by spacer members which are absent in FIG. 1.

For introducing the endless felt belt 23, the belt 23 is hung in the form of a partially unwound open belt loop on a frame 40. The frame 40 is suspended by chains 39 from a traveling crane (not shown) and the frame is lifted into the belt introduction position. The frame 40, which is shown somewhat larger in FIGS. 2 and 3, has two substantially identical spaced apart side parts 41. Only one part 41 is visible in FIGS. 1 to 3, since these are side views. Each side part 41 has respective recesses 42, 43 at its opposite ends into which respective support bars 44 and 45 can be inserted. The support bars also serve as the sole transverse connections between the spaced side parts 41, which aids in rapid disassembly and reassembly of the frame. The length of the support bars is somewhat greater than the width of the endless felt belt 23 so that the felt belt can be suspended unwrinkled on the frame 40. The support bars 44 and 45 preferably consist of tubular material. A clamping device, comprising an angle lever 46 held to a respective side part by a screw spindle 47, serves to fasten the support bar 44 in the side part 41. A somewhat larger angle lever 48 in FIG. 1 held by screw spindle 49 to the side part forms a clamping device for the support bar 45, and at the same time serves as a clamping device for holding the felt belt 23 fast, as will be described below.

Figure 2:
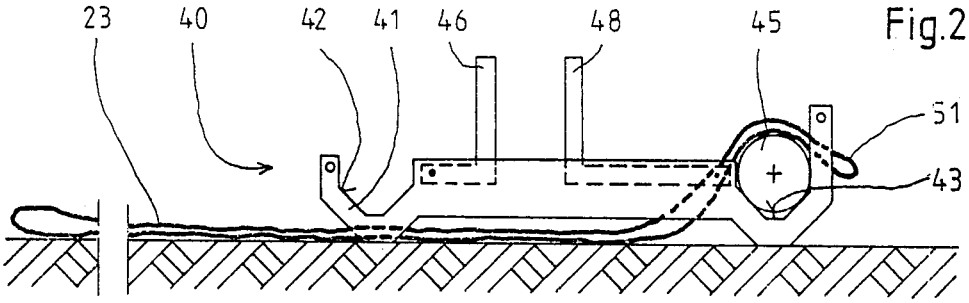
FIGS. 2 and 3 show two stages in the preparation of the process for the introduction of the felt.
Figure 3:
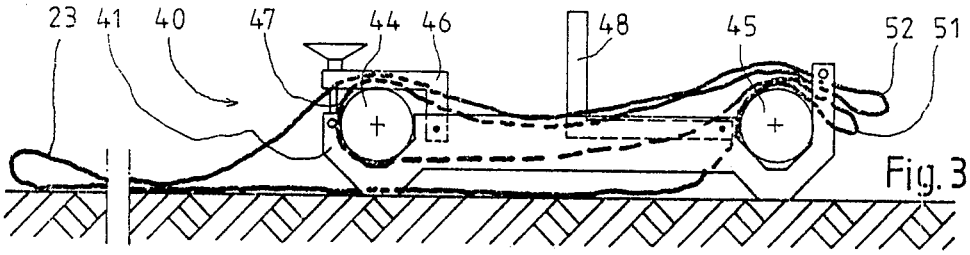

To hang the felt belt 23 on the frame 40, the latter is first placed on the floor without the support bar 44, as shown in FIG. 2. The felt belt is unwound and spread out on the floor. One end is placed in the form of a first fold 51 on the support bar 45, as shown in FIG. 2. Then, as shown in FIG. 3, the support bar 44 is inserted into the side parts 41 and is fastened there by the clamping devices 46, 47. Next, a second fold 52 is formed in the felt belt 23, as that belt is pulled over the support bar 44 and the second fold is deposited on the support bar 45. To hold the felt belt 23 fast in the frame 40, another bar 50 is placed above the support bar 45 and is fastened there by the clamping device 48, 49 which is moved to the position shown in FIG. 1. In this way, the support bar 45 is also fixed to the side parts 41.

The frame 40 is next raised together with the felt belt 23 and is introduced into the paper machine as shown in FIG. 1. The clamping device 48, 49 is opened with the frame 40 there, whereupon the upper region of the felt belt 23 drops onto the guide rolls 18, 19. The frame 40 can then be immediately removed from the paper machine. The tensioning roll 19 is now moved from its position on block 15 and is placed into the position 19′. Intermediate spacer members are inserted in the gaps 26, 27 and the bearing support block 15 is lowered onto these members by reducing the pressure of the hydraulic cylinder 25. The spaces 38 and 29 are also filled by intermediate members. Then the roll press is again ready to operate.

Figure 4:
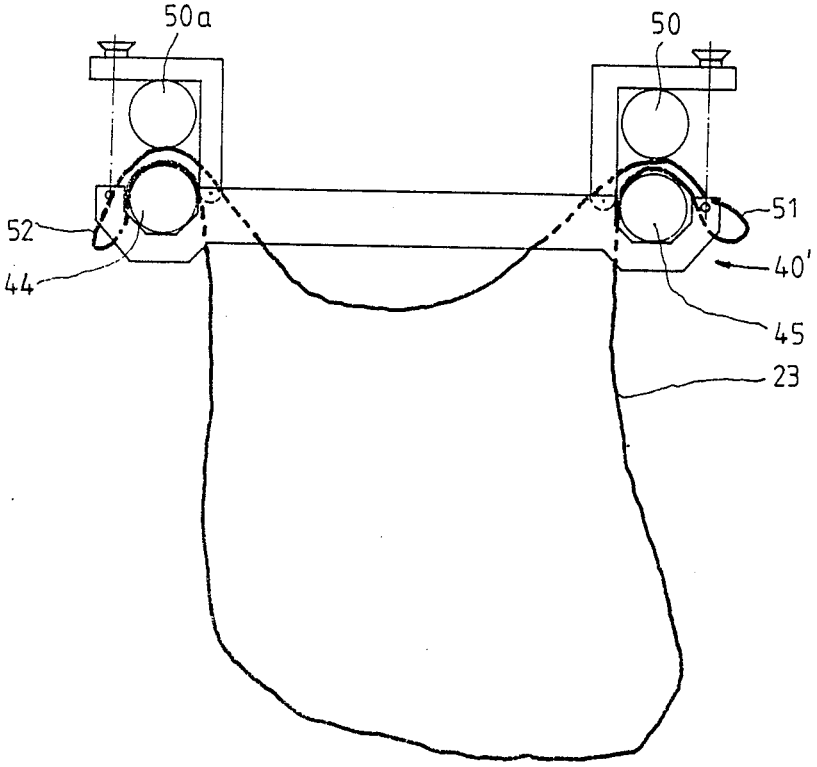
FIGS. 4 and 5 respectively show two alternate embodiments of the invention.

FIG. 4 diagrammatically shows that the felt belt 23 can be held fast in the frame 40′ by clamping folds 51 and 52, in this embodiment at opposite ends of the frame, firmly to the corresponding support bars 45 and 44 by the respective additional bars 50 and 50*a*. This method is advisable when the felt belt is relatively short and there is a large distance between the two support bars 44 and 45. However, it is a disadvantage that two additional bars 50 and 50*a* are required rather than only one.

Figure 5:
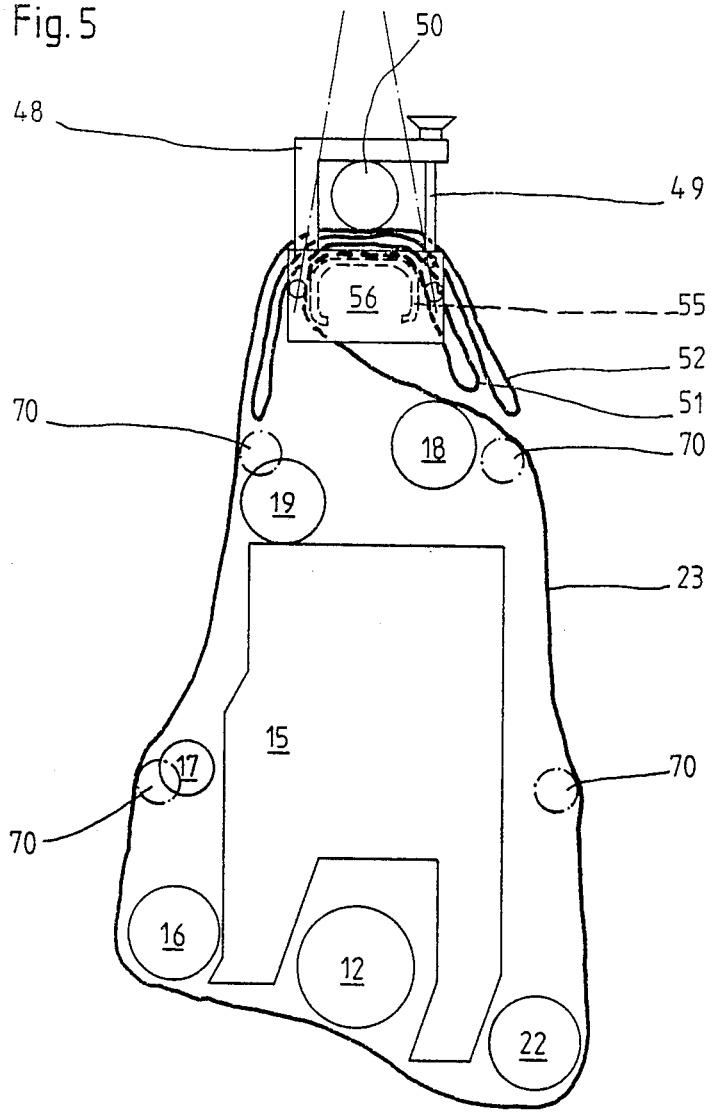

FIG. 5 shows, again in contour, the bearing support block 15 and the rolls 12, 16, 17, 18, 19 and 22 of FIG. 1. There is a simpler felt introduction device, as compared with FIG. 1. Only a single support bar 55 is present. Although it could be made of tubular material, a profiled metal sheet bent into a downwardly open C shape is shown. The bar 55 is provided at each end with a side shield 56. Similar to FIGS. 1 to 4, an angle lever 48 and a screw spindle 49 are fastened to the shield 56. They can clamp the felt belt 23 fast between a clamping bar 50 which clamps against the top of the support bar 55. The felt belt cannot be spread out into as wide a belt loop as in FIGS. 1 and 4 with this device alone (i.e. without additional measures). However, guide bars 70 which facilitate the introduction of the belt loop can be arranged on the platforms located alongside the paper machine on the operator's side. It is beneficial if there are two guide bars located at the same height and arranged obliquely as seen from above, so that they approach each other in the direction toward the outside of the paper making machine. They can thereby widen the belt loop during the course of their introduction.

Although the present invention has been described in connection with a number of preferred embodiments thereof, many variations and moficiations will now become apparent to those skilled in the art. It is preferred, therefore, that the present invention be limited not by the specific disclosure herein, but only by the appended claims.

What is claimed is:

1. Device for introducing an endless loop, flexible belt into a paper making machine, the device comprising:

at least one support bar, of a length approximately the width of the belt, and oriented to extend across the belt and from which the belt is suspended, the support bar being located so as to be outside the loop of the belt, with the belt having an overlay region in which one portion of the belt overlays another portion of the belt, said overlay region extending over the support bar; and a clamping device disposed at the support bar and placed for clamping to the overlay region of the belt at the support bar; and means for operating the clamping device to clamp the overlay region of the belt at the support bar, so that the overlay region remains laid over the support bar, the means being operable to release the clamping device to release the overlay region of the belt clamped thereby.

2. In combination, a device for introducing an endless loop, flexible belt into a paper making machine, the device comprising:

at least one support bar, of a length approximately the width of the belt, and oriented to extend across the belt and from which the belt will be suspended, the support bar being located so as to be outside the loop of the belt, with the belt having an overlay region in which one portion of the belt overlays another portion of the belt, said overlay region extending over the support bar;

a clamping device disposed at the support bar and placed for clamping to the overlay region of the belt at the support bar; and means for operating the clamping device to clamp the overlay region of the belt at the support bar, so that the overlay region remains laid over the support bar, the means being operable to release the clamping device to release the overlay region of the belt clamped thereby; and an endless loop belt supported to the device and being clamped at the one support bar by the clamping device; the support bar being outside the loop of the belt; the belt extending over the support bar outside the loop of the belt for defining the overlay region of the belt, which lies over the support bar and which is clamped at the support bar.

3. The device of claim 2, wherein there is a single one of the support bars.

4. The device of claim 2, wherein the clamping device comprises an additional bar clampable against the support bar for clamping an overlay region of the belt between the additional bar and the support bar.

5. In combination, a device for introducing an endless loop, flexible belt into a paper making machine, the device comprising:

two parallel, spaced apart support bars, each of a length approximately the width of the belt and each oriented to extend across the belt and from which the belt will be suspended, each support bar being located so as to be outside the loop of the belt, and the belt having at least one overlay region in which one portion of the belt overlays another portion of the belt, said overlay region extending over at least one of the support bars;

a respective clamping device disposed at each support bar and being placed for clamping the overlay region of the belt at that support bar; and respective means for operating each of the clamping devices to clamp the respective overlay region of the belt at the respective support bar, so that the respective overlay region remains laid over the respective support bar, the means being operable to release the respective clamping device to release the respective overlay region of the belt clamped thereby; and an endless loop belt supported to the device, wherein the belt extends over one of the support bars to define a first one of the overlay regions of the belt; and a part of the loop belt, which is not the first overlay region, extends over a second one of the support bars to define a second one of the overlay regions of the belt lying over the second support bar; a respective one of the clamping devices clamping the belt to each of the support bars.

6. The device of claim 5, further comprising a frame having two opposite lateral side parts at the opposite lateral sides of the belt, and the side parts being placed so that the two support bars extend between the side parts.

7. The device of claim 6, wherein the support bars are the sole connecting elements extending transversely between the two side parts of the frame.

8. The device of claim 6, further comprising open recesses in the side parts for permitting installation of the support bars therein from above; and second clamping devices for clamping the support bars in the recesses in the side parts.

9. The device of claim 8, wherein the first-mentioned one of the clamping devices, for clamping the overlay region of the belt at the one support bar, also is at least one of the second clamping devices for clamping that respective one of the support bars in the respective recess therefor.

10. The device of claim 6, wherein the clamping device comprises an additional bar clampable against a respective one of the support bars, for clamping an overlay region of the belt between the additional bar and the respective support bar.

11. A press section in a paper making machine the press section comprising opposite lateral sides, a continuous loop belt, and supporting means for the continuous belt around which the belt passes; the supporting means comprising a cantilever supporting beam extending between the lateral sides of the press section;

the press section including pressing means and the belt passing the pressing means;

at least one support bar approximately as long as the belt is wide, said support bar being outside the loop of the belt and temporarily supporting the belt; the support bar being above the supporting means and the pressing means; the support bar being introduceable into the press section from one lateral side and also being removable from the press section;

the belt defining at least one overlay region in which one portion of the belt overlays another portion of the belt, said overlay region extending over the support bar in the press section while the support bar is supporting the belt; and a clamping device disposed at the support bar and placed for temporarily clamping the overlay region of the belt to the support bar, and which is releasable for freeing the belt from the support bar, the belt thereafter being supported on the supporting means.

12. The paper making machine of claim 11 further comprising an additional support bar in the press section but outside the loop of the belt and having substantially the same dimension across the width of the belt as the first-mentioned support bar, the belt having a second overlay section for resting on the additional support bar in the press section, wherein the plurality of support bars temporarily support the belt.

13. Device for introducing an endless loop, flexible belt into a paper making machine, the device comprising:

two, parallel, spaced apart support bars, each of a length approximately the width of the belt and each oriented to extend across the belt and from which the belt is suspended, each support bar being located so as to be outside the loop of the belt, and the belt will have at least one overlay region in which one portion of the belt overlays another portion of the belt, said overlay region extending over at least one of the support bars; and a respective clamping device disposed at each support bar and being placed for clamping the overlay region of the belt at that support bar; and respective means for operating each of the clamping devices to clamp the respective overlay region of the belt at the respective support bar, so that the respective overlay region remains laid over the respective support bar, the means being operable to release the respective clamping device to release the respective overlay region of the belt clamped thereby.

* * * * *